US010156805B2

(12) United States Patent
Mor-Yosef et al.

(10) Patent No.: US 10,156,805 B2
(45) Date of Patent: Dec. 18, 2018

(54) GAP CONTROL

(71) Applicant: HEWLETT-PACKARD INDIGO B.V., Amstelveen (NL)

(72) Inventors: Avichay Mor-Yosef, Jerusalem (IL); Ami Halfon, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 23 days.

(21) Appl. No.: 15/545,959

(22) PCT Filed: Apr. 14, 2015

(86) PCT No.: PCT/EP2015/000786
§ 371 (c)(1),
(2) Date: Jul. 24, 2017

(87) PCT Pub. No.: WO2016/165725
PCT Pub. Date: Oct. 20, 2016

(65) Prior Publication Data
US 2018/0004112 A1 Jan. 4, 2018

(51) Int. Cl.
*G03G 15/02* (2006.01)

(52) U.S. Cl.
CPC ..... *G03G 15/025* (2013.01); *G03G 15/0216* (2013.01)

(58) Field of Classification Search
USPC .... 399/38, 50, 110, 111, 115, 168; 118/671; 162/198, 263, 344
See application file for complete search history.

(56) References Cited

U.S. PATENT DOCUMENTS

| | | | | |
|---|---|---|---|---|
| 5,552,865 | A * | 9/1996 | Osawa | G03G 15/0216 399/168 |
| 6,106,671 | A * | 8/2000 | Heaven | D21F 1/06 118/671 |
| 6,533,154 | B2 | 3/2003 | Kitai et al. | |
| 7,778,560 | B2 * | 8/2010 | Ishibashi | G03G 15/0266 399/50 |
| 7,869,741 | B2 * | 1/2011 | Mayuzumi | G03G 15/0233 399/115 |
| 7,873,291 | B2 * | 1/2011 | Kosuge | G03G 15/5008 399/44 |
| 8,172,166 | B2 | 5/2012 | Inoue et al. | |
| 8,401,449 | B2 | 3/2013 | Condello et al. | |
| 8,438,976 | B2 | 5/2013 | Levanon et al. | |
| 8,789,462 | B2 | 7/2014 | Chauvin et al. | |
| 2012/0193870 | A1 | 8/2012 | Taig | |
| 2014/0064812 | A1 | 3/2014 | Yu et al. | |

FOREIGN PATENT DOCUMENTS

JP 2011037168 2/2011

OTHER PUBLICATIONS

Hirakawa, Hiroyuki, et al., "Mechanism of Contact Charging Photoconductor and Insulator with DC-biased Conductive Roller", IEEE, 1995, pp. 1539-1542.

* cited by examiner

*Primary Examiner* — Hoan Tran
(74) *Attorney, Agent, or Firm* — HP Inc. Patent Department

(57) ABSTRACT

In one example, a device includes a flexible roller and an actuator to flex the roller while it is rotating to change the gap between the roller and a surface opposite the roller.

13 Claims, 5 Drawing Sheets

GAP CONTROL

BACKGROUND

Liquid electro-photographic (LEP) printing uses a special kind of ink to form images on paper and other print substrates. LEP inks include toner particles dispersed in a carrier liquid. Accordingly, LEP ink is sometimes called liquid toner. In LEP printing processes, an electrostatic pattern of the desired printed image is formed on a photoconductor. This latent image is developed into a visible image by applying a thin layer of LEP ink to the patterned photoconductor. Charged toner particles in the ink adhere to the electrostatic pattern on the photoconductor. The liquid ink image is transferred from the photoconductor to an intermediate transfer member (ITM) that is heated to transform the liquid ink to a molten toner layer that is then pressed on to the print substrate.

DRAWINGS

FIG. 1 illustrates one example of a device with two rollers separated by a gap, such as might be implemented in an LEP printer charging system that utilizes a charge roller and photoconductor roller.

FIGS. 2-6 present a sequence of views illustrating one example for adjusting a gap between two surfaces, such as might be used to control the gap between the rollers shown in FIG. 1.

The same part numbers designate the same or similar parts throughout the figures. The figures are not necessarily to scale.

DESCRIPTION

In some LEP printing processes, the photoconductor is implemented as a photoconductive surface on the outside of a cylindrical roller. A cylindrical charge roller is used to charge the photoconductive surface uniformly before it is patterned for the desired printed image. As the two rollers rotate, the surfaces of the photoconductor roller and the charge roller pass very close to one another across a small gap. The uniformity of the charge applied to the photoconductor is effected by the uniformity of the gap between the two rollers. It is usually desirable to maintain a uniform gap between the charge roller and the photoconductor roller.

During printing, a charge roller can sag under its own weight by as much as a few microns, contributing to a non-uniform gap that can adversely affect photoconductor charging. A new technique has been developed to compensate for a sagging charge roller to help maintain the desired gap between the photoconductor roller and the charge roller for more uniform charging. In one example, the charge roller is supported on two sets of bearings—a first set of radially stationary bearings and a second set of radially movable bearings outboard from the stationary first bearings. The second bearings can be moved radially, creating a misalignment between the two sets of bearings that flexes a sagging charge roller to recover the desired gap. A control system may be used to monitor the gap during printing and adjust the position of the outboard bearings to correct any unacceptable changes in the gap.

Examples are not limited to sagging charge rollers in an LEP printer, but may be implemented in other rollers, with other deformations, and for uses other than printing. The examples shown in the figures and described herein illustrate but do not limit the scope of the patent, which is defined in the Claims following this Description.

As used in this document: "flexible" means capable of bending or being bent; and "roller" means a rotatable shaft, drum or other cylindrical part or assembly. A "gap" as used in this document includes the gap at any or all locations between two surfaces. Thus, measuring the gap may include measuring the gap at one location or at multiple locations. Similarly, changing the gap may include changing the gap at one location or at multiple locations.

Figure 1:
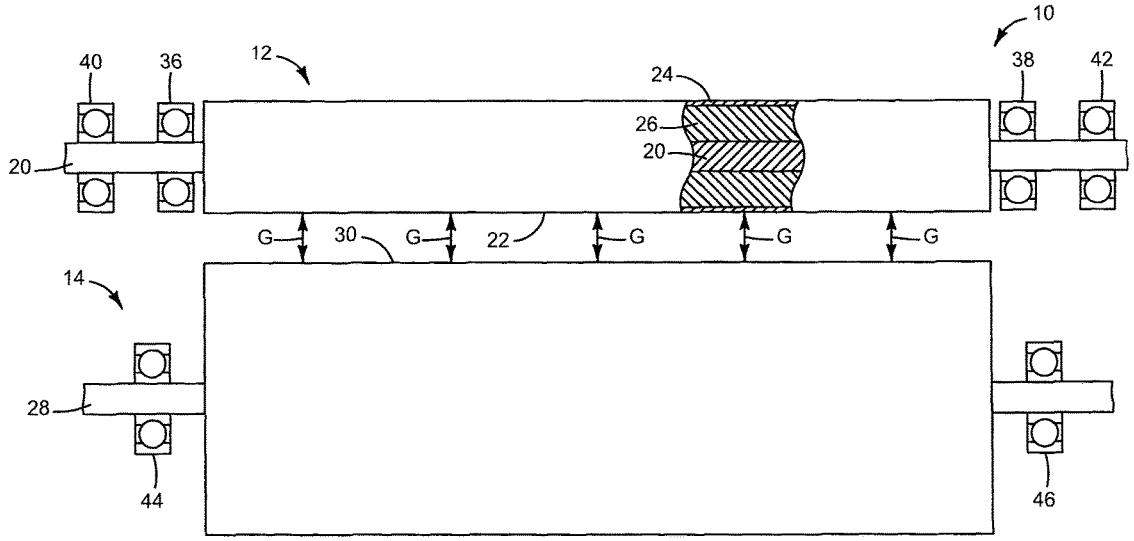

FIG. 1 illustrates one example of a device 10 with two rollers 12, 14 separated by a gap G. The device 10 in FIG. 1 may represent, for example, an LEP printer charging assembly with a charge roller 12 and a photoconductor roller 14. Referring to FIG. 1, first roller 12 includes a shaft 20 and a cylindrical exterior surface 22 operatively connected to shaft 20. Shaft 20 and surface 22 form an integrated structure in which surface 22 rotates and flexes with shaft 20. A charging roller 12, for example, may include a cylindrical metal shell 24 attached to shaft 20 with radial struts 26. (Two struts 26 are visible in axial section in FIG. 1.) Shell 24 may itself form exterior surface 22 or a dielectric or other coating on shell 24 may form surface 22. Other configurations for a roller 12 in general, and specifically a charging roller 12, are possible. For example, roller 12 could be configured as a solid cylinder with a single diameter in which shaft 20 forms surface 22.

Second roller 14 includes a shaft 28 and a cylindrical exterior surface 30 that rotates with shaft 28. Although a photoconductor roller 14 is usually larger and more stiff than a charging roller 12, and not subject to sagging to change gap G during printing operations, thermal expansion may change the shape of surface 30 to adversely affect gap uniformity. Thus, surface 30 on roller 14 in FIG. 1 may also be constructed to flex with shaft 28.

First roller 12 is supported on shaft 20 by two sets of bearings 36, 38 and 40, 42. Second roller 14 is supported on shaft 28 by bearings 44, 46. For first roller 12, each inboard bearing 36, 38 is stationary radially and each outboard bearing 40, 42 is movable radially. As described below with reference to FIGS. 2-6, outboard bearings 40, 42 may be moved radially to flex roller 12 to adjust gap G. Outboard bearings 40, 42, therefore, are sometimes referred to herein as gap control bearings 40, 42.

Figure 2:
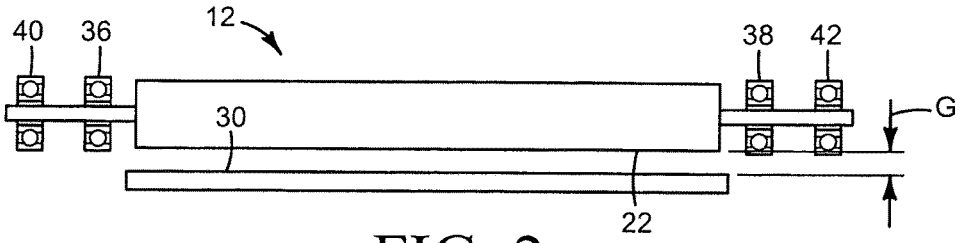
Figure 3:
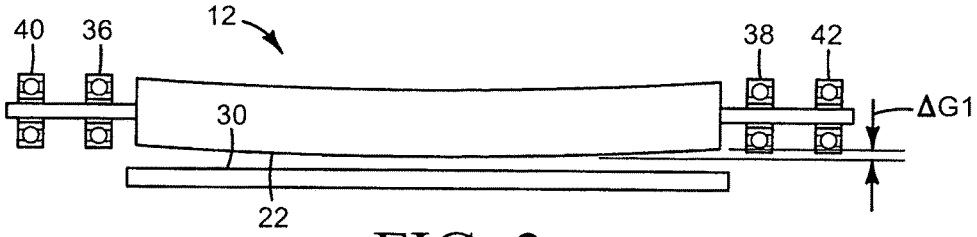
Figure 4:
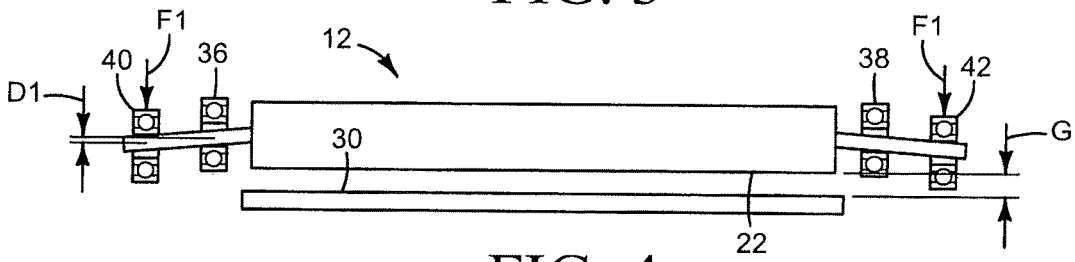
Figure 5:
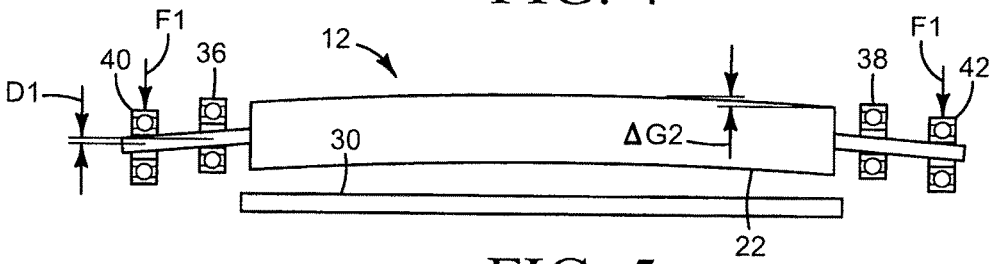
Figure 6:
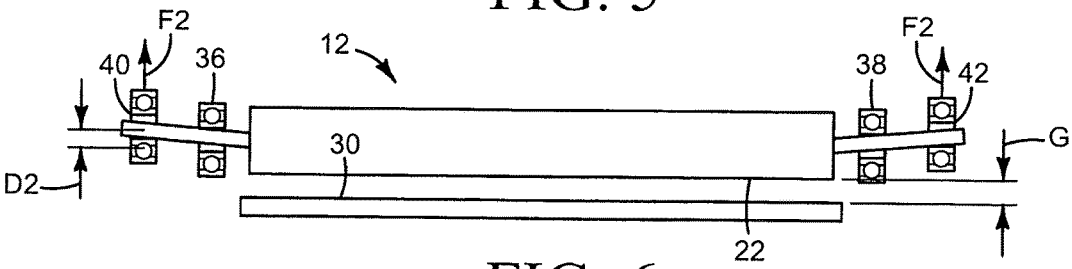

FIGS. 2-6 present a sequence of views illustrating one example for adjusting a gap G, using gap control bearings 40, 42 on a roller 12. FIGS. 2-6 show a stationary, inflexible second surface 30. Other configurations for second surface 30 as possible including, for example, the surface of a second roller 14 as shown in FIG. 1. Referring first to FIG. 2, outboard bearings 40, 42 are aligned with inboard bearings 36, 38 and gap G is uniform between parallel surfaces 22 and 30. In FIG. 3, outboard bearings 40, 42 are aligned with inboard bearings 36, 38 and roller 12 is bowed in, toward second surface 30, creating a non-uniform gap G that varies by $\Delta G1$ between non-parallel surfaces 22 and 30. In FIG. 4, each outboard bearing 40, 42 is moved radially at the urging of a force F1, out of alignment with inboard bearings 36, 38 a distance D1 to flex roller 12 axially along the length of the roller and restore a uniform gap G between parallel surfaces 22 and 30. In FIG. 5, outboard bearings 40, 42 are out of alignment with inboard bearings 36, 38 a distance D1 and roller 12 is bowed out, creating a non-uniform gap G that varies by ΔG2 between non-parallel surfaces 22 and 30. In FIG. 6, each outboard bearing 40, 42 is moved radially at the urging of a force F2 a distance D2 to flex roller 12 axially along the length of the roller and bow down first surface 22, restoring a uniform gap G between parallel surfaces 22 and 30.

Figure 7:
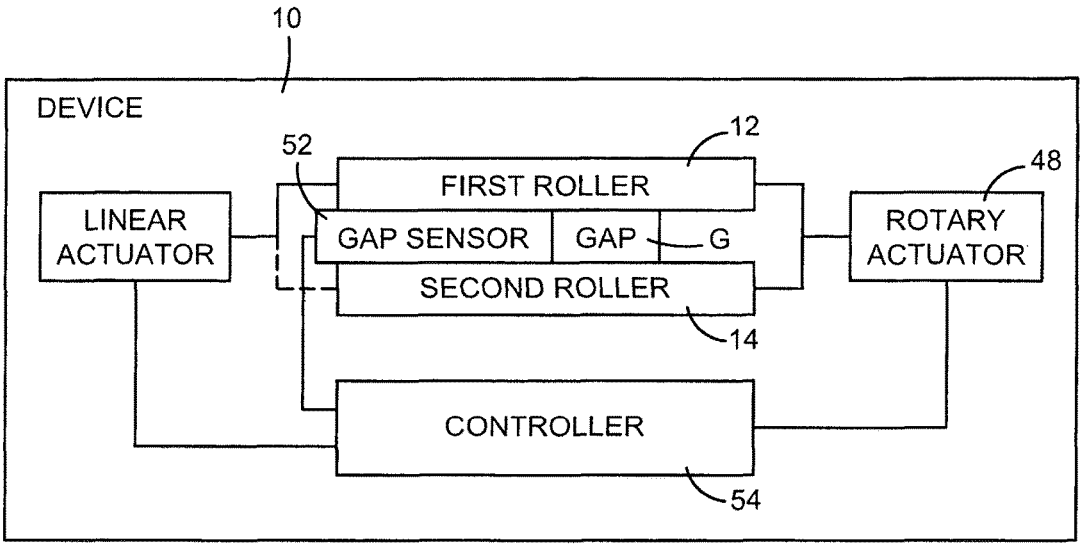
FIG. 7 is a block diagram illustrating one example of a device with a system to automatically control a gap between two rollers.

While two gap control iterations are illustrated in the process for adjusting gap G shown in FIG. 2-6, the process may be automated to dynamically adjust the gap periodically or continually, for example while rollers 12, 14 in an LEP printer charging system 10 (FIG. 1) are operating. The block diagram of FIG. 7 illustrates a device 10 with a system to automatically control gap G between rollers 12 and 14. Referring to FIG. 7, device 10 includes a rotary actuator 48 to rotate rollers 12, 14 and a linear actuator 50 to flex one or both rollers 12, 14. Rotary actuator 48 may be configured, for example, as a variable speed motor (or motors) operatively connected to rollers 12 and 14 through a suitable drive train. Linear actuator 50 may be configured, for example, as a stepper motor (or motors) operatively connected to roller 12 and/or roller 14 through a suitable linkage to displace one or both ends of the roller as described above with reference to FIGS. 2-6.

Device 10 also includes a sensor (or sensors) 52 to measure gap G. Sensor 52 represents generally any suitable device for measuring gap G. For one example, for very small gaps such as those between a charge roller 12 and a photoconductor roller 14 in an LEP printer, a sensor 52 that monitors voltage or current flow across gap G may be used to signal changes in gap G. For another example, an optical sensor 52 may be used to measure gap G directly.

A controller 54 is operatively connected to actuators 48, 50 and sensor 52 to control gap G while rotating rollers 12, 14. Controller 54 receives signals from sensor 52 measuring the gap and, if the measured gap is not within an acceptable range of gaps, controller 54 signals linear actuator 50 to flex one or both rollers 12, 14 to change the gap. Controller 54 includes the programming, processors and associated memories, and the electronic circuitry and components needed to control actuators 12, 14 and other operative elements of device 10. Where device 10 is part of a larger system, for example a charging system in an LEP printer, some or all of the components and control functions for controller 54 may be implemented in a system controller. Controller 54 may include, for example, an individual controller for each actuator 48, 50 operating at the direction of a programmable microprocessor that receives signals or other data from sensor 52 to generate drive parameters for the actuators.

Figure 8:
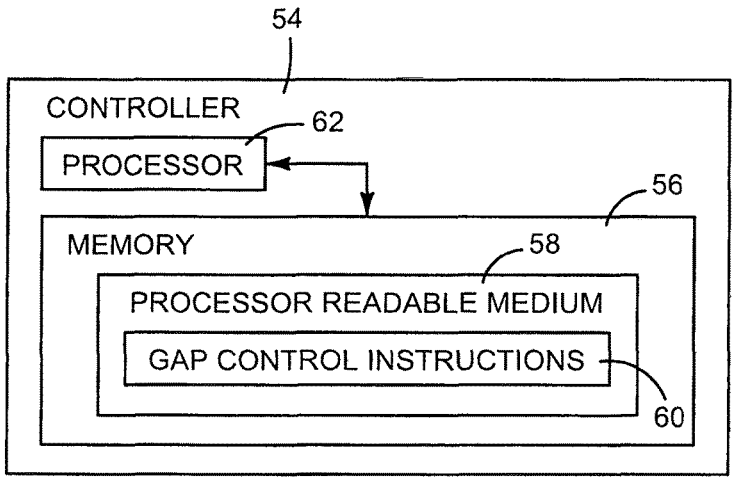
FIG. 8 is a block diagram illustrating one example of a controller such as might be used in the gap control system shown in FIG. 7.

In particular, and referring to FIG. 8, controller 54 may include a memory 56 having a processor readable medium 58 with gap control instructions 60 and a processor 62 to read and execute instructions 60. A processor readable medium 58 is any non-transitory tangible medium that can embody, contain, store, or maintain instructions 60 for use by processor 62. Processor readable media include, for example, electronic, magnetic, optical, electromagnetic, or semiconductor media. More specific examples of processor readable media include a hard drive, a random access memory (RAM), a read-only memory (ROM), memory cards and sticks and other portable storage devices.

Figure 9:
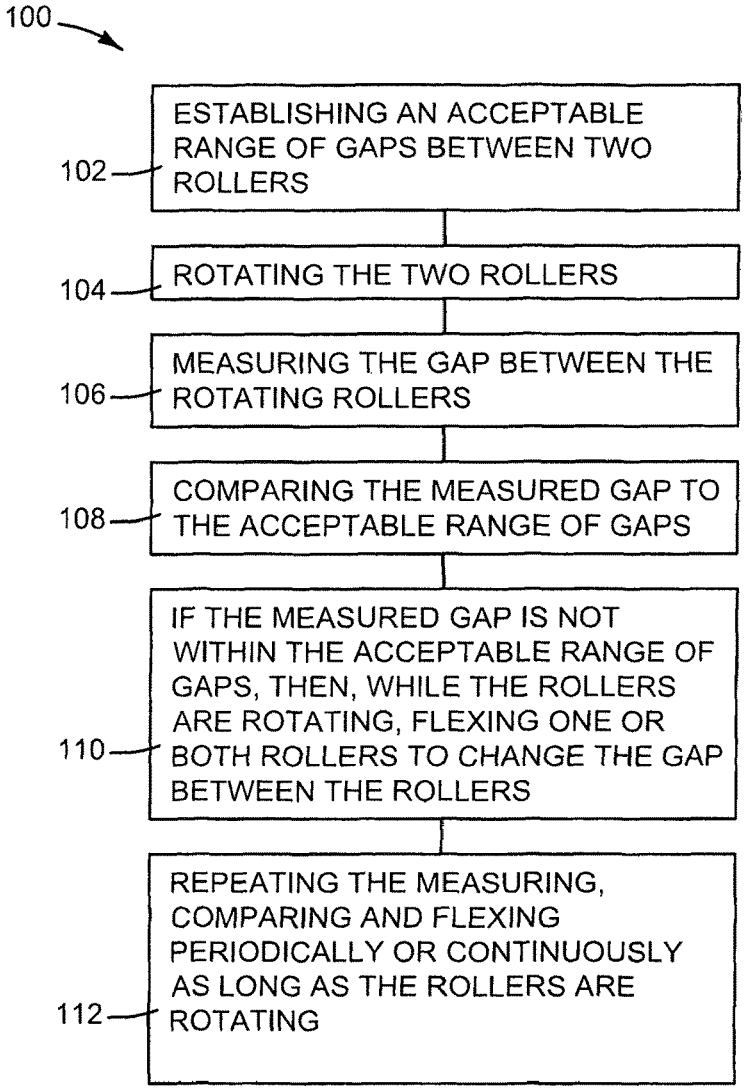
FIGS. 9 and 10 illustrate example gap control processes such as might be implemented in the gap control system shown in FIG. 7.
Figure 10:
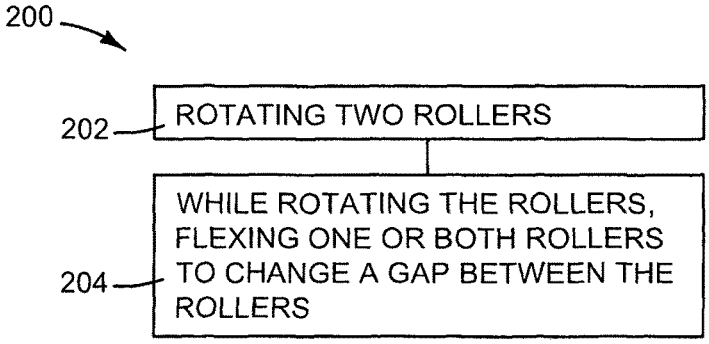

FIGS. 9 and 10 illustrate example gap control processes 100 and 200 such as might be implemented through instructions 60 on controller 54. Referring first to FIG. 9, in gap control process 100 an acceptable range of gaps between two rollers is established at block 102. The two rollers are rotated (block 104), for example at the direction of controller 54 and rotary actuator 48 in FIG. 7. The gap between the rotating rollers is measured (block 206), for example using sensor 52 in FIG. 7. The measured gap is compared to the acceptable range of gaps established at block 102 (block 108), for example by processor 58 executing instructions 60 in FIG. 7. If the measured gap is not within the acceptable range, then one or both of the rotating rollers is/are flexed to change the gap between the rollers (block 110), for example at the direction of controller 54 and linear actuator 50 in FIG. 7. The measuring, comparing, and flexing is repeated periodically or continuously while the rollers are rotating to maintain the gap within the acceptable range (block 112).

More generally, a gap control process 200 shown in FIG. 10 includes rotating two rollers (block 202) and, while rotating the rollers, flexing one or both rollers to change a gap between the rollers (block 204).

Figure 11:
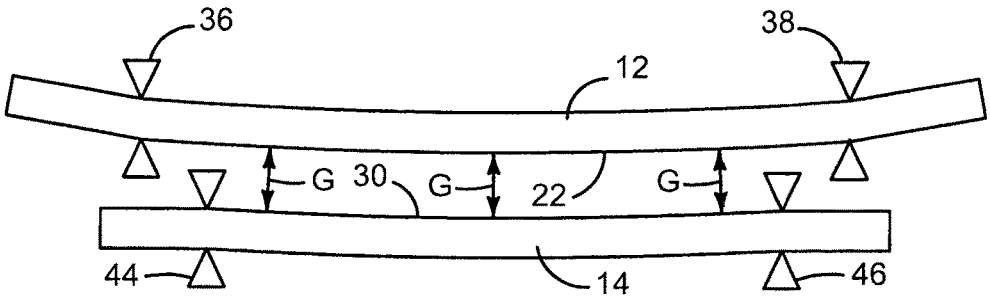
FIGS. 11-14 illustrate other examples for controlling a gap between two rollers.
Figure 12:
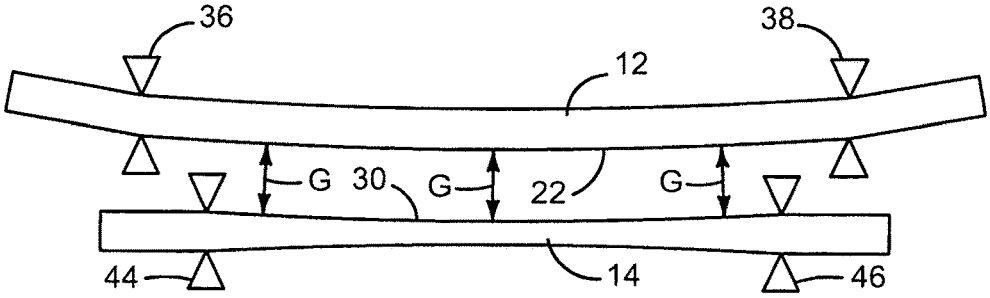
Figure 13:
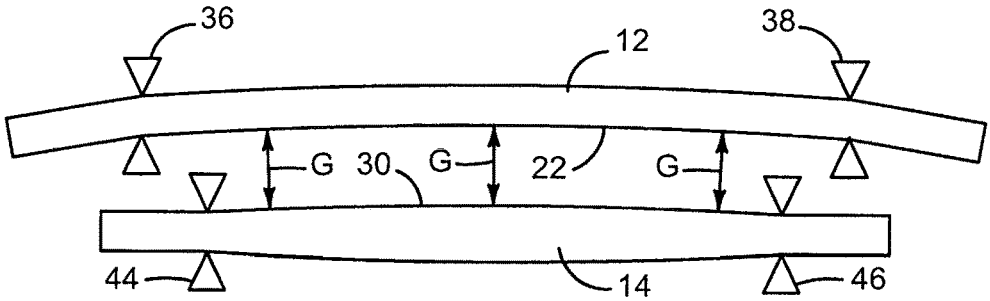
Figure 14:
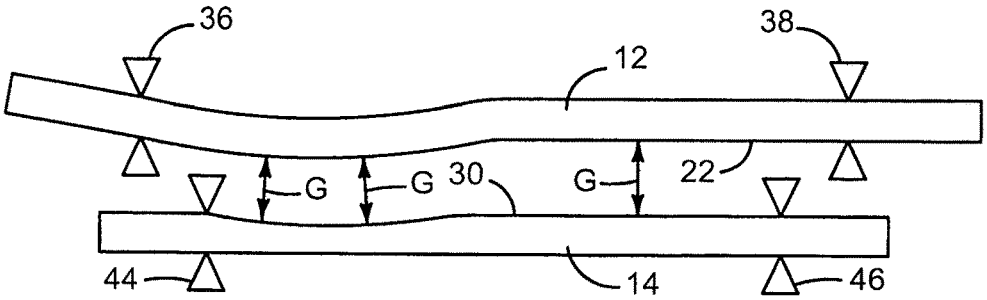

FIGS. 11-14 illustrate other examples for controlling a gap G between two surfaces 22 and 30. In the examples shown in FIGS. 11-14, each surface 22, 30 is configured as the exterior part of a roller 12, 14 supported at each end by a bearing or other suitable radially stationary support 36, 38, 44, and 46. In FIG. 11, both ends of roller 12 are displaced radially up to flex roller 12 axially down to compensate for a bowing roller 14, for example due to loading or sagging, thus restoring a uniform gap G between surfaces 22 and 30. In FIG. 12, both ends of roller 12 are displaced radially up to flex roller 12 axially down to compensate for a necking roller 14, for example due to thermal contraction, thus restoring a uniform gap G between surfaces 22 and 30. In FIG. 13, both ends of roller 12 are displaced radially downward to flex roller 12 axially up to compensate for a bulging roller 14, for example due to thermal expansion, thus restoring a uniform gap G between surfaces 22 and 30. In FIG. 14, only one end of roller 12 is displaced up to flex one part of roller 12 down to compensate for a roller 14 necking unevenly, for example due to an uneven temperature distribution, thus restoring a more uniform gap G between surfaces 22 and 30.

The size of gap G, the size of gap variations ΔG, and the restoring displacements D1 and D2 are greatly exaggerated in the figures. For example, the gap variations ΔG and radial displacements D for a charging roller 12 and a photoconductor roller 14 in an LEP printer may be only a few microns. The actual gaps and the actual restoring displacements needed to correct a gap variation will vary depending on the particular implementation, including the size, material, and geometries of the rollers and bearings as well as the operating conditions and dynamics within the device or system.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

What is claimed is:

1. A device, comprising:

a flexible roller having a first surface;

a second surface opposite the first surface;

a gap between the first surface and the second surface; and an actuator to flex the roller axially along a length of the roller while the roller is rotating to change the gap between the surfaces.

2. The device of claim 1, comprising:

a sensor to measure the gap; and a controller operatively connected to the sensor and to the actuator to flex the roller in response to a signal from the sensor.

3. The device of claim 2, where the controller includes a processor and a processor readable medium with instructions thereon that when executed by the processor cause the controller to:

receive a signal from the sensor measuring the gap;

compare the measured gap to an acceptable range of gaps;

if the measured gap is not within the acceptable range, then signal the actuator to flex the roller to change the gap; and repeating the receiving and comparing while the roller is rotating, and repeating the signaling if the measured gap is not within the acceptable range.

4. The device of claim 1, where the actuator to flex the roller axially while it is rotating to change the gap between the surfaces includes a linear actuator to displace one or both ends of the roller radially while the roller is rotating.

5. The device of claim 4, where the actuator is to simultaneously displace both ends of the roller radially while the roller is rotating.

6. A device, comprising:

a first roller having a first surface;

a second roller having a second surface opposite the first surface;

a gap between the first surface and the second surface;

a radially stationary first bearing supporting each end of the first roller;

a radially movable second bearing supporting each end of the first roller outboard from the first bearings; and an actuator to move one or both of the second bearings radially with respect to the corresponding first bearing to change the gap between the surfaces.

7. The device of claim 6, where the actuator is to move one or both of the second bearings while the first roller is rotating.

8. The device of claim 7, where the actuator is to move both of the second bearings simultaneously while the first roller is rotating.

9. The device of claim 8, comprising:

a sensor to measure the gap; and a controller operatively connected to the sensor and to the actuator to move the second bearings in response to a signal from the sensor.

10. The device of claim 9, where the controller includes a processor and a processor readable medium with instructions thereon that when executed by the processor cause the controller to:

receive a signal from the sensor measuring the gap;

compare the measured gap to an acceptable range of gaps;

if the measured gap is not within the acceptable range, then signal the actuator to move the second bearings to change the gap; and repeating the receiving and comparing periodically or continuously while the roller is rotating, and repeating the signaling if the measured gap is not within the acceptable range.

11. A process to adjust a gap between two rollers, comprising:

rotating the rollers; and while rotating the rollers, flexing one or both rollers axially along a length of the roller to change the gap.

12. The process of claim 11, where the flexing includes displacing one or both ends of a roller radially.

13. The process of claim 12, comprising, while rotating the rollers, detecting the gap outside an acceptable range and where the displacing includes displacing both ends of a roller in response to the detecting, to restore the gap to the acceptable range.

* * * * *